United States Patent [19]

Maurer

[11] 3,969,988

[45] July 20, 1976

[54] ARRESTING DEVICE FOR IMPACT DRIVE TOOLS

[75] Inventor: Werner Maurer, Zizishausen, Germany

[73] Assignee: Karl M. Reich Maschinenfabrik GmbH, Nuertingen, Germany

[22] Filed: July 24, 1974

[21] Appl. No.: 491,265

[30] Foreign Application Priority Data

Aug. 2, 1973 Germany ..... 2339162

[52] U.S. Cl. ..... 92/19; 92/26; 92/30; 227/130

[51] Int. Cl.[2] ..... F15B 15/26

[58] Field of Search ..... 92/15, 18, 19, 23, 27, 92/28, 85, 249, 13.6, 30, 26; 227/130

[56] References Cited

UNITED STATES PATENTS

| | | | |
|---|---|---|---|
| 1,248,861 | 12/1917 | Holloway | 92/23 X |
| 2,130,618 | 9/1938 | Gnavi | 92/27 X |
| 2,559,478 | 7/1951 | Stone | 92/30 X |
| 2,985,139 | 5/1961 | Powers et al. | 92/85 X |
| 3,104,395 | 9/1963 | Grey, Jr. et al. | 92/85 X |
| 3,188,921 | 6/1965 | Bade | 92/85 X |
| 3,351,257 | 11/1967 | Reich et al. | 227/130 |
| 3,397,617 | 8/1968 | Cast et al. | 227/130 X |

FOREIGN PATENTS OR APPLICATIONS

| | | | |
|---|---|---|---|
| 530,834 | 2/1921 | France | 92/30 |

*Primary Examiner*—Martin P. Schwadron
*Assistant Examiner*—Abraham Hershkovitz
*Attorney, Agent, or Firm*—W. G. Fasse; W. W. Roberts

[57] ABSTRACT

An impact drive tool is provided with a percussive piston arranged in a cylinder. A rod on the piston is mounted to drive a nail or other object into a workpiece. A valve arrangement is provided to apply compressed air to the upper surface of the piston, and a storage chamber communicating with the space below the piston is provided for returning the piston to a rest position. A plurality of sequentially arranged latching devices are provided for locking the piston in its rest position, the latching device effective at a given time being dependent on such factors as friction in the device and the amount of compressed air stored for the return stroke. A buffer surface is provided to effect the absorption of energy if the piston passes all of the latching devices, and to rebound the piston to the nearest latching device.

5 Claims, 3 Drawing Figures

ARRESTING DEVICE FOR IMPACT DRIVE TOOLS

BACKGROUND OF THE INVENTION:

The present invention relates to impact drive tools, for example, for driving nails, staples, or the like, and is particularly directed to the provision of an arresting device for such impact drive tools.

Impact drive tools of one type are provided with a cylinder having a pressure chamber adapted to be connected to a supply of compressed air by way of an inlet valve. An air chamber is provided for storing compressed air, in order to drive the percussive piston to its rest position following an impact stroke. A rubber-elastic arresting element is provided for locking the percussive piston in its rest position, the lock on the piston being released by the force of compressed air applied to the piston in its impact stroke.

An arresting device of the above type is described, for example, in German Pat. No. 1,288,527. In this arrangement the arresting device is provided with a rubber-elastic holding element which at least partially forms a latch, in order to elastically lock the percussive piston in a rest position.

Due to the nature of the operation of impact drive tools of this type, return forces of varying amplitude act on the percussive piston during the return stroke, the amplitude of the force depending upon the air pressure employed. In order to adapt such tools to required conditions, such as the differing lengths of the nails, and the hardness of wood into which the nails must be driven, the pressure of the compressed air applied to the tool may be changed. Changing of the air supply pressure, however, also changes the pressure of compressed air stored in the air chamber for the return of the percussive piston. As a result, the percussive piston strikes the arresting device, which is employed to arrest the piston over the entire range of its impact speeds, with varying speeds.

When minimum air pressure is employed, an energy surplus is required in order to insure safe engagement of the piston in the latch of the arresting element. When maximum air pressure is employed, this energy surplus may cause the percussive piston to strike the elastic buffer surface of the arresting device at high speeds, and to cause its rebound in such a way that it overcomes the holding force of the latch and drops downwardly in the cylinder to a greater or lesser extent. Consequently, when the next impact is to be triggered off in the tool, there is either no impact at all, or an impact with reduced energy. As a result, the nail or similar object is not driven completely into the workpiece as desired.

OBJECTS OF THE INVENTION

In view of the foregoing, it is the aim of the invention to achieve the following objects singly or in combination:

to provide an arresting device for an impact drive tool which overcomes the above disadvantage of the known arrangement; and to provide an arresting device of the above described type, which gradually brakes the percussive piston as it moves into the arresting device to thereby hold the piston securely in its rest position at any pressures of compressed air supply employed for operation of the impact drive tool.

SUMMARY OF THE INVENTION

In accordance with the invention, the above objects are achieved by providing an arresting device for an impact tool, comprised of a plurality of axially spaced apart latching devices, to enable the elastic latching of the percussive piston.

In one embodiment of an arresting device in accordance with the invention, an elastic sleeve if fixedly mounted at the end of the cylinder, the piston having a head adapted to move into the sleeve. The sleeve is provided with a plurality of axially spaced apart bulges positioned to engage an annular groove adjacent the head of the piston.

In this arrangement, the bulges are preferably provided with sloping conical surfaces on their lower sides facing the percussive piston, in order to enable the percussive piston to pass the bulges more easily. In addition, such shaping of the bulges results in less wear to the bottom of the bulges, where they are initially struck by the piston. The tops of the bulges preferably have annular surfaces in planes normal to the axis of the cylinder, the annular groove in the top of the piston having a similar shaped annular surface for engaging the tops of the bulges, in order to hold the piston in its rest position.

In a further embodiment of the invention, the arresting device may be comprised of a plurality of axially spaced apart annular grooves in the inner wall of the cylinder. A further annular groove is provided on the piston, and an O-ring is inserted in the ring of the piston. The O-ring has an outer diameter greater than that of the piston, in order to engage the annular grooves in the top of the piston to effect a latching action. The groove in the piston has sufficient depth, so that when compressed air is applied to the piston to release the latching thereof, the rubber-elastic forces on the O-ring force the O-ring into the groove in the piston, to thereby release the lock.

BRIEF FIGURE DESCRIPTION

In order that the invention may be more clearly understood, it will now be described, by way of example, with reference to the accompanying drawings, wherein.

DETAILED DESCRIPTION OF EXAMPLE EMBODIMENT

Figure 1:
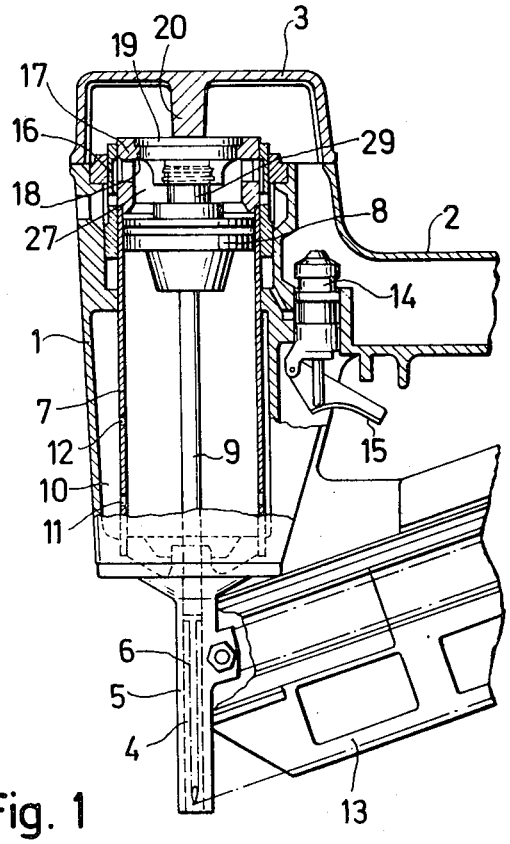
FIG. 1 is a partially sectional side view of an impact drive tool incorporating an arresting device in accordance with one embodiment of the invention.

Referring now to the drawings, and more specifically to FIG. 1, an impact drive tool in accordance with the invention, for example, for the percussive driving of nails and the like, is comprised of a hollow casing 1 having a hollow handle adapted to be connected to a source of compressed air by conventional means, such as a plug connection (not shown). The open top of the casing is covered by a cover 3, and a cylinder foot 4 is secured to the bottom of the casing 1. The cylinder foot 4 has a central feed duct 5 for receiving nails 6 to be percussively driven by the tool.

A cylinder 7 is fixedly mounted within the casing 1, coaxial with the feed duct 5. An impact piston 8 is slidably positioned in the cylinder 7. An impact ram 9 is rigidly connected to the bottom of the piston 8 and extends downwardly into the upper end of the feed duct 5. The feed duct 5 thus guides the lower end of the impact ram 9.

The portion of the casing 1 surrounding the lower end of the cylinder 7 is radially spaced from the outer wall of the cylinder 7, in order to define a closed air store chamber 10. The chamber 10 is connected to the inside of the cylinder by bores 11 located adjacent the bottom end of the cylinder 7 and by a bore 12 through the cylinder 7 at a position axially above the bores 11.

A magazine 13 for holding a strip of nails, is affixed to the cylinder foot and the handle 2, in order to enable the feeding of nails into the feed duct 5.

A holding ring 17 is affixed to the upper end of the cylinder 7 and extends coaxially therewith. The holding ring holds an arresting element 19 in the upper end of a concentric bore 18 in the holding ring 17. A projection 20 extending downwardly from the inside of the cover 3 abuts the top of the arresting element 19 to hold it in the ring 17.

The upper ends of the cylinder 7 and the casing 1 form an annular chamber surrounding the upper end of the cylinder 7, and a valve ring 16 is axially slidably mounted within this chamber. A release valve 14, operable by means of a trigger lever 15, controls the application of air from the handle 2 through a duct leading to the bottom of the chamber below the valve ring 16, so that the air passing through the duct forces the valve ring 16 upwardly. The release valve 14 vents upon operation the chamber below the valve ring 16 in its non-operated position to permit the valve ring to move to its lowermost position.

The valve ring 16 is provided with lateral ports and an annular groove on its inner surface adjacent to and connected to the ports. The holding ring 17 is provided with a number of ports extending outwardly from a chamber 27 between the arresting element 19 and the top of the piston 8. An annular chamber surrounding the valve ring 16 is connected to an exhaust port in the casing 1.

In the upper position of the valve ring 16, the ports therethrough are aligned with the annular chamber in the casing 1. In this position of the valve ring 16 its inner annular groove communicates with the ports in the holding ring 17, whereby the chamber 27 is vented by way of the ports through the holding ring, the annular groove in the valve ring 16, the ports in the valve ring 16, the annular chamber in the casing 1 and the exhaust port of the casing 1.

In this position of the valve ring 16, the upper end of the valve ring inhibits passage of air from the handle 2 through the cover 3 into the chamber 27. A suitable sliding seal is provided between the upper end of the casing 1 and the outer surface of the valve ring 16.

By triggering the release valve 14 the valve ring 16 is moved into its lower position by venting the ring space below the valve ring 16 and by air pressure acting on its upper edge exposed to the chamber within the cover 3. In this lower position the ports of the valve ring 16 are closed off from the ports in the holding ring 17.

The valve ring is moved enough so that there is provided a communicating path between the inner space of the cover 3 and the ports in the holding ring 17. Thus, a pressure medium such as compressed air in the handle 2, may pass through the cover 3 and through the ports in the holding ring 17 and into the chamber 27. The foregoing valve operation is conventional.

Figure 2:
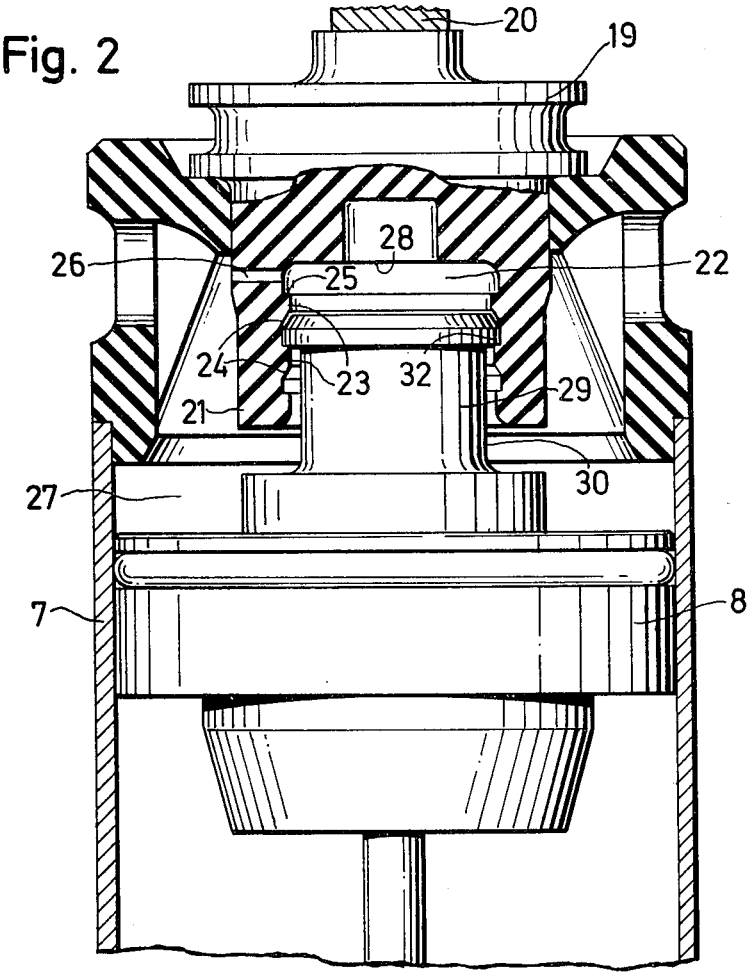
FIG. 2 is an enlarged sectional view of the arresting device illustrated in FIG. 1.

In FIG. 2 the arresting element 19 is, for example, made of an elastic material, such as rubber-elastic material. A downwardly extending cylindrical sleeve 21 of the element 19 is aligned with the percussive piston 8. The interior 22 of the sleeve 21 is provided with a plurality of radially inwardly extending annular bulges 23, which are axially spaced apart. The lower surface 24 of the bulges have sloping conical surfaces, so that the bulges taper outwardly and in the downward direction. The upper surface 25 of the bulges are formed as horizontal ring-shaped areas, which extend substantially in planes normal to the longitudinal axis of the cylinder 7. An air passage 26 extends through the wall of the sleeve 21 to interconnect the chamber 27 with the upper end of the interior 22 of the sleeve 21 to vent the sleeve when a piston head end moves into the sleeve. The inner end of the interior 22 of the sleeve 21 is shaped to form a buffer surface 28 in a plane normal to the axis of the cylinder 7.

The upper end of the piston 8 carries said head end 29 extending toward the arresting element 19. The head 29 is provided below its upper shoulder with an annular groove 30 into which the bulges 23 may extend in the upper position of the piston 8. The upper end of the ring groove 30 lies in a plane normal to the axis of the cylinder 7, thus forming a shoulder 32 engaging the upper surface 25 of one of the bulges 23. The axial length of the groove 30 is sufficient so that when the top of the head 29 engages the buffer surface 28, all of the bulges 23 may extend into the annular groove 30.

In the upper or rest position of the impact piston 8, as shown in FIG. 1, the interior chamber 27 of the cylinder 7 is closed off from the pressure medium supply in the handle 2 by the inlet valve 16, as above discussed. In this rest position the percussive piston 8 is held in an upper position by one of the bulges 23. Upon actuation of the release valve 14 by means of the trigger lever 15, the chamber below the valve ring 16 is vented to move the valve ring 16 to its lowermost position. As discussed above, in this position the compressed air may then flow from the handle 2 into the interior chamber 27. This compressed air exerts a downwardly directed force on the percussive piston 8.

As soon as the force on the piston 8 exceeds the elastic holding force of the sleeve 21, the percussive piston 8 is released from the bulge 23 due to elastic expansion, and the pistion 8 is accelerated downwardly.

As a consequence, a nail 6 in the guide duct 5 is driven by the ram 9 into a workpiece. The downward movement of the percussive piston 8 displaces air within the cylinder by way of the bores 11, into the air storage chamber 10, whereby the air pressure within this chamber increases to store energy for the piston return.

When the percussive piston 8 passes the bore 12 in the cylinder 7, the air storage chamber is exposed to the air pressure in the interior chamber 27, thereby supplementing the pressure in the air storage chamber 10.

When the trigger lever 15 is released, compressed air from the handle 2 is directed to the chamber below the valve ring 16, so that the valve ring 16 is forced to its uppermost position.

As discussed above, this results in the removal of air pressure from the interior chamber 27 and the venting of this chamber by way of the exhaust port in the casing 1. The pressure built up in the air storage chamber then acts on the lower surface of the percussive piston 8 to move the percussive piston back to its upper or reset position. Since the air storage chamber 10 has a limited volume, it can exert an upward or return stroke force on the percussive piston only for a short period of time. The return stroke force must be adequate to safely convey the percussive piston to an upper position so that it may be held in the upper position. The impulse of air pressure applied to the percussive piston from the air storage chamber 10 moves the piston head end 29 with its shoulder into engagement with one of the bulges 23, whereby the pressure within the air storage chamber 10 and the friction between the percussive piston 8 and the cylinder 7 and between the impact ram 9 and the feed duct 5 will determine how far up the piston will be moved. If the return stroke energy is initially great, it is reduced as the upper end of the head end 29 of the piston 8 passes the bulges 23 since the head end 29 stretches the sleeve 21 as the head end 29 passes the bulges. Any residual energy remaining after the head end 29 has passed all of the bulges, is absorbed by the buffer area 28. The sleeve 21 is surrounded by a free space to facilitate said stretching of the sleeve 21 by said shoulder of the head 29 of the piston.

Although the percussive piston 8 may be resiliently bounced back when the head end 29 strikes the buffer area 28, the next adjacent bulge 23 will safely hold the piston because the upper area 25 of this bulge engages the shoulder 32 of the ring groove 30 to hold the percussive piston in place.

When the head end 29 moves into the interior 22 of the sleeve 21 air will be compressed in the interior 22 resulting in an undesirable spring rebound effect. The air passage 26 in the wall of the sleeve 21 avoids this effect by permitting the compressed air to vent into the interior chamber 27 of the cylinder 7. The cross section of the air passage 26 may be dimensioned so that a soft impact between the head 29 and the buffer surface 28 is insured for the maximum return stroke speed of the percussive piston, as the air passage 26 throttles the air forced from the interior 22 to the chamber 27.

In the arrangement of the invention, as illustrated in FIG. 2, the head end 29 of the percussion piston preferably has a circular cross section of a diameter substantially equal to the inner diameter of the sleeve 21 at the base of the grooves. The radially outward upper edge of the head 29 is beveled, to form a frusto-conical surface similar to the shape of the conical surfaces 24. While the previous description has referred to the interior of the sleeve 21 as having bulges 23, it is apparent that it is equally applicable to describe the configuration of the interior of the sleeve 21 as having a plurality of annular grooves with upper conical surfaces and lower edges in planes normal to the axis of the cylinder 7. FIG. 2 further illustrates a recess in the arresting element 19 extending to the surface 28. Such recess may be provided so that the resulting surface 28 has the desired area for the arresting effect as above described.

Figure 3:
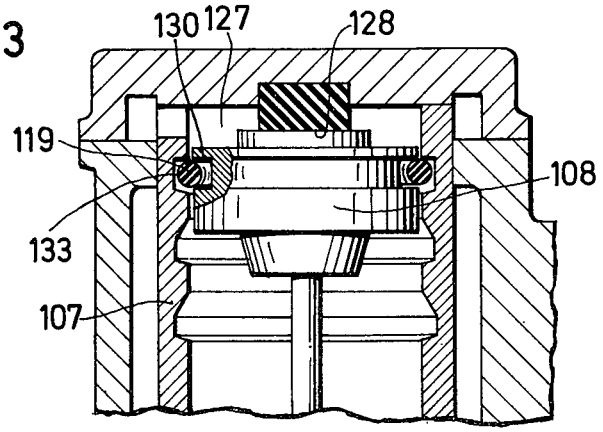
FIG. 3 is a sectional view of a modified arresting device for an impact tool, in accordance with a further embodiment of the invention.

FIG. 3 illustrates a modification of an arresting arrangement in accordance with the invention. In this figure, where correspondence exists between the elements and elements of FIGS. 1 and 2, such corresponding elements have reference numerals increased by 100 from the reference numerals in FIGS. 1 and 2. The release valve and inlet valve employed in combination with the arrangement of FIG. 3 correspond in their functions to the arrangement illustrated in FIG. 1, but in this case, the valves may be provided in the handle.

Referring now to FIG. 3, the percussive piston 108 is movable in the cylinder 107, and in the uppermost or rest position, the top of the piston lies against a buffer area 128. Thus, the upper open end of the casing in FIG. 3 may be provided with a cover having suitable ports (not shown) to permit the entry of compressed air from a control valve in the handle to the chamber 127 above the piston 8. The valves may be of conventional type, which admit compressed air to the chamber 127 in the operated position and vent the pressure of the chamber 127 in the release position. The buffer surface 128 may be the surface of an elastic body affixed to the inside of the cover of the casing, as illustrated in FIG. 3.

The upper inside surface of the cylinder 107 is provided with a plurality of axially spaced apart ring grooves 133, and a ring groove 130 is provided in the outer radial surface of the piston 108. An O-ring 119 is fitted in the ring groove 130. The O-ring 119 has a larger outer diameter than the percussive piston 108, so that in the rest position of the percussive piston, the O-ring simultaneously engages the ring groove 130 and one of the ring grooves 133 of the cylinder 107. This results in the locking of the percussive piston 108 to the cylinder 107. The ring groove 130 has sufficient depth that the O-ring 119 can be completely pressed into the groove 130, against its elastic forces, to permit the piston 108 to be forced past the grooves 133.

In the arrangement of FIG. 3, when compressed air is introduced above the piston 108, the piston is forced downwardly. As soon as the force is adequate to press the O-ring 119 into the ring groove 130, the lock between the O-ring 119 and a groove 133 is released, so that the piston 108 may be moved abruptly downwardly by the compressed air. When the piston 108 is moved upwardly, under the force of stored air, it will be locked to the upper end of the cylinder 7 by engagement of the O-ring with one of the grooves 133, the groove 133 in which the locking takes effect being determined, for example, by the friction in the device as well as the pressure of the stored air. The buffer surface 128 acts in the same manner as the buffer surface 28 of FIG. 2, in further arresting movement of the piston 108 when necessary.

In the arrangement of FIG. 3, since the chamber 127 is vented when the piston 108 is moving upwardly, no further venting port is required to avoid a spring rebound effect.

In the arrangement in accordance with the invention, it is thus apparent that the percussive piston engages only the first latch in its course at lower pressures, when it has a low return stroke speed. The piston is then in a rest position which is below the maximum possible impact stroke, and consequently during the next impact stroke it not only disengages more easily from the arresting device, but also develops less impact energy due to the reduced impact stroke. This is desirable, for example, when very short nails are to be driven into very soft wood. In order to allow the impact drive tool to function satisfactorily, the air pressure must not be set below a specific lower limit, for example, 45 psi. It is apparent that the impact energy may, in various cases be undesirably great, if the impact stroke is fully utilized, and hence the provision of a plurality of latches at different strokes of the piston enables control of the operation of the device with respect to a given application.

When a maximum pressure is required, however, the energy of motion of the percussive piston resulting from the return stroke is gradually reduced when passing the sequentially arranged latches, so that at the end of its impact stroke, the percussive piston can be intercepted by the buffer area 128 and can be safely held by the corresponding latch. The gradual absorption of the return stroke energy imposes only a very small stress on the buffer area of the arresting device and on the parts of the impact drive tool supporting the arresting devices, so that the device has a correspondingly long life.

The full impact stroke is available, when the piston 8 is latched in the last latching device, i.e., the closest to the buffer surface, so that on the next impact the impact drive tool may be employed with its maximum energy.

In the arrangement of FIGS. 1 and 2, the sleeve 21 is fixedly mounted on its end thereof facing away from the percussive piston. As a consequence, the end of the sleeve toward the percussive piston is more easily deformed or stretched in the operation of the device, by the passage therethrough of the head 29, so that greater forces are required to release the head 29 from the bulges closer to the buffer area. This effect is desirable, since a greater force must be built up to release the piston 8 when it is locked in the position closest to the buffer surface, and hence where the piston has its maximum stroke and must deliver the greatest impact energy.

Although the invention has been described with reference to specific example embodiments, it is to be understood, that it is intended to cover all modifications and equivalents within the scope of the appended claims.

What is claimed is:

1. In an impact tool having a cylinder with a longitudinal axis, a percussive piston movable in the cylinder, pressure medium supply means secured to one end of the cylinder for applying pressure to one end of said piston to cause said piston to travel in an impact stroke, pressure storage means at another end of the cylinder for storing pressure medium during an impact stroke for returning the piston to a rest position at said one end of the cylinder following the impact stroke, and an arresting device including a stationary member at said one end of said cylinder and a locking shoulder at the upper end of said piston movable with the piston for holding the piston in said rest position in the absence of pressure for causing stroking of the piston and for releasing the piston upon the application of sufficient pressure medium to cause an impact stroke, the improvement wherein said stationary member of said arresting device comprises a rubber elastic sleeve including a plurality of rubber elastic arresting bulges inside said sleeve, each rubber elastic arresting bulge including a first ring surface slanted at a given angle relative to said longitudinal axis to flare outwardly and to face toward said percussive piston, and a second ring surface facing away from said percussive piston and forming an angle with said longitudinal axis, which is larger than said given angle, and means axially spacing said rubber elastic arresting bulges apart with respect to said longitudinal cylinder axis to form grooves inside said stationary rubber elastic arresting sleeve, said shoulder of said piston deflecting said bulges radially outwardly until the shoulder is locked by one of said bulges in any one of a plurality of positions in said cylinder during the return piston stroke, the locking position of said piston being determined by the stored pressure for returning the piston.

2. The impact tool of claim 1, wherein said rubber elastic sleeve is a cylindrical sleeve, said piston comprising a ring groove below said shoulder, said ring groove having an axial length sufficient to receive said plurality of arresting bulges in the uppermost rest position of the piston.

3. The impact tool of claim 1, wherein said sleeve comprises passage means extending through the wall thereof to release pressure medium when said shoulder of said piston enters into said sleeve.

4. The impact tool of claim 1, wherein said second ring surfaces facing away from said piston extend substantially at a right angle to the axis of said cylinder, and wherein said first ring surfaces flaring outwardly and facing said piston facilitates the sliding of the shoulder of said piston into said sleeve.

5. The impact tool of claim 1, wherein said sleeve is surrounded at its lower end by a free space to facilitate said deflecting of said bulges by said shoulder of the piston.

* * * * *